US008573448B2

(12) United States Patent
Ding

(10) Patent No.: US 8,573,448 B2
(45) Date of Patent: Nov. 5, 2013

(54) LOTION PUMP

(76) Inventor: Yaowu Ding, Taixing (CN)

( * ) Notice: Subject to any disclaimer, the term of this patent is extended or adjusted under 35 U.S.C. 154(b) by 470 days.

(21) Appl. No.: 12/303,786

(22) PCT Filed: Sep. 7, 2006

(86) PCT No.: PCT/CN2006/002317

§ 371 (c)(1),
(2), (4) Date: Dec. 8, 2008

(87) PCT Pub. No.: WO2007/143889

PCT Pub. Date: Dec. 21, 2007

(65) Prior Publication Data

US 2010/0219209 A1 Sep. 2, 2010

(30) Foreign Application Priority Data

Jun. 9, 2006 (CN) ..... 2006 1 0027488

(51) Int. Cl.
*B67B 1/00* (2006.01)

(52) U.S. Cl.
USPC ..... 222/153.13; 222/321.9; 222/385

(58) Field of Classification Search
USPC ..... 222/153.13, 321.7, 321.9, 321.1, 321.8, 222/385
See application file for complete search history.

(56) References Cited

U.S. PATENT DOCUMENTS 2,956,509 A * 10/1960 Cooprider et al. ..... 417/561
4,022,354 A * 5/1977 Kotuby ..... 222/321.2
4,051,983 A * 10/1977 Anderson ..... 222/321.2
4,109,832 A * 8/1978 Kutik et al. ..... 222/318
4,286,736 A * 9/1981 Corsette ..... 222/153.13
4,340,158 A * 7/1982 Ford et al. ..... 222/153.13
4,369,899 A * 1/1983 Magers et al. ..... 222/153.13
4,538,748 A * 9/1985 Ford et al. ..... 222/153.13
5,401,148 A * 3/1995 Foster et al. ..... 417/547

(Continued)

FOREIGN PATENT DOCUMENTS

CN 1597136 Y 3/2000
CN 2371155 Y 3/2000

(Continued)

OTHER PUBLICATIONS

International Search Report of PCT/CN2006/002317, dated Mar. 29, 2007.

*Primary Examiner* — Kevin P Shaver
*Assistant Examiner* — Daniel R Shearer
(74) *Attorney, Agent, or Firm* — Hamre, Schumann, Mueller & Larson, P.C.

(57) ABSTRACT

The present invention provides a lotion pump, comprises: a nozzle head; a plunger connected with the nozzle head, in which an upper one-way valve is disposed; a container cap which is engaged with a mouth of a bottle; a housing, its upper end is connected to the container cap, and on its lower end there is a lower one-way valve; and a spring, its lower end abuts against the bottom of the housing, and its upper end abuts against the head of the plunger; characterized in that, the diameter of an upper portion of the plunger is larger than that of a lower portion of the plunger, thereby a step is formed at the position where the diameter is changed, said step forms a valve seat for said upper one-way valve. The lotion pump of the present invention can be realized by a very simple structure, minimum parts and a very low manufacturing cost. While greatly increasing the productivity, it can obtain good sealing and leak-proof performance.

9 Claims, 4 Drawing Sheets

(56) References Cited

U.S. PATENT DOCUMENTS

| | | | | | |
|---|---|---|---|---|---|
| 5,638,996 | A | * | 6/1997 | Montaner et al. | 222/321.2 |
| 5,715,973 | A | * | 2/1998 | Foster et al. | 222/153.13 |
| 5,738,250 | A | * | 4/1998 | Gillingham et al. | 222/153.13 |
| 5,794,821 | A | * | 8/1998 | Foster et al. | 222/321.9 |
| 5,927,561 | A | * | 7/1999 | Foster et al. | 222/321.9 |
| 6,006,946 | A | * | 12/1999 | Williams et al. | 221/9 |
| 6,006,949 | A | * | 12/1999 | Foster et al. | 222/153.13 |
| 6,045,008 | A | * | 4/2000 | Fernandez et al. | 222/153.13 |
| 6,334,549 | B1 | * | 1/2002 | Fernandez et al. | 222/153.13 |
| 6,729,500 | B1 | | 5/2004 | Dobbs et al. | |
| 2010/0230443 | A1 | | 9/2010 | Ding | |

FOREIGN PATENT DOCUMENTS

| | | | |
|---|---|---|---|
| CN | 2578249 | Y | 10/2003 |
| CN | 2745881 | A | 3/2005 |
| JP | 2005-118724 | A | 5/2005 |

* cited by examiner

LOTION PUMP

TECHNICAL FIELD

The present invention relates to a lotion pump used in the fields of chemical articles for daily use and medicine.

BACKGROUND ART

Lotion pumps have already been widely used in the industries of chemical articles for daily use and medicine. In the conventional lotion pumps, the container cap and the housing cap are separately arranged. In order to further reduce the cost and to make the manufacturing and installation more convenient, the inventor of this application filed an application titled "Multi-Functional Lotion Pump" with the CPO in Mar. 29, 1999, and being patented as ZL99207292.1. In the multi-functional lotion pump, the container cap is integrated with the housing cap and the number of the injection molded parts is reduced to four, thereby the manufacturing cost is greatly reduced, and the requirement on engagement between the parts are minimized.

However, in the above mentioned multi-functional lotion pump, some problems are still to be resolved.

Firstly, it is difficult to accomplish the orientation. In the conventional lotion pump, in which the container cap and the housing cap are separately arranged, when the container cap is not screwed tightly, the container cap and housing cap can be rotated relatively. Therefore, when the lotion is filled at the factory, the nozzle of the spray head can be turned to a desired angle, and after the container cap is screwed tightly, the direction of the nozzle is also fixed in the desired direction. However, in the above-mentioned multi-functional lotion pump, because the housing cap and the container cap are integrated with each other, it is impossible to use the above-mentioned method to adjust the direction. Hence, for the same lotion pump, if it is used in container bottles with different heights of mouth, the direction of the nozzle will be different. For the same container bottle, if different lotion pumps are used, it is possible that the directions of the nozzles will be different. In addition, the heights of the two sets of screw teeth of the nozzle head and of the housing cap should be identical at the stop position, which will render much difficulty to the manufacturing of the mold and the process control. Even the above-mentioned precision can be reached, it is needed to increase the precision requirement on the mouths of the container bottles to guarantee the consistency of the heights of the mouths.

Next, the spring with varying diameters cannot guarantee the sealing performance of the lower ball. In the above-mentioned multifunctional lotion pump, the sealing of the nozzle, when the nozzle head is locked, is realized by pressing the spring with varying diameters onto the lower one-way valve ball. This makes higher demands on the compression degree and the coaxiality of the spring, the height and the diameter of the spring at the portion with the thinnest diameter, and the height of the ball support. If these demands are not satisfied, it is difficult to realize the reliable sealing.

Furthermore, too much screw threads and the spring with varying diameters would increase the manufacturing cost. The nozzle head of the above-mentioned multiple-functional lotion pump has one set of screw teeth, the container cap has three sets of screw teeth. The production cycle of such screw threads is relatively longer, some complex molds have to be used, and the mounting and engagement of two sets of screw teeth takes more time, thereby not favorable to the production in large batches and to reach high efficiency. In addition, the quantity of raw material to be used for the spring with varying diameters is rather high, and the cycle for manufacturing is rather long, leading to a relatively high cost.

Finally, the structure of the valve seat of the upper one-way value is rather complex. In the above-mentioned multi-functional lotion pump, the valve seat of the upper one-way valve is disposed within the plunger, forming a "V" structure. This valve seat structure makes the mold design and the entire molding process complex, and makes the resistance in the passage for lotion relatively large.

SUMMARY OF THE INVENTION

In order to overcome the above-mentioned drawbacks, the object of the present invention is to provide a lotion pump, which features a simple structure, less parts, reduced cost and improved sealing performance.

In order to realize the object, the present invention provides a lotion pump, comprises: a nozzle head; a plunger connected with the nozzle head, in which an upper one-way valve is disposed; a container cap which is engaged with a mouth of a bottle; a housing, its upper end is connected to the container cap, and on its lower end there is a lower one-way valve; and a spring, its lower end abuts against the bottom of the housing, and its upper end abuts against the head of the plunger; characterized in that, the diameter of an upper portion of the plunger is larger than that of a lower portion of the plunger, thereby a step is formed at the position where the diameter is changed, said step forms a valve seat for said upper one-way valve.

Preferably, wherein an inner ring is disposed in the container cap, any one of at least one guiding grove and at least one guiding block is disposed on the inner ring, and the other one of the at least one guiding groove or the at least one guiding block is disposed on the lower portion of the plunger.

Preferably, on the lower surface of the inner ring and on the upper surface of the guiding block, there is an engagement means for making them engage with each other.

Preferably, one side of a lower portion of the guiding groove is in an arc shape, and on the other side there is a protrusion to limit the rotation range of the guiding block.

Preferably, on any one of the lower portion of the housing and the lower portion of the plunger there is any one of the sealing ring and the sealing plug, on the other one of the lower portion of the housing and the lower portion of the plunger there is the other one of the sealing ring and the sealing plug, said sealing ring and said sealing plug engage with each other to reach a seal.

Preferably, said container cap and said housing are connected by means of ribs and grooves.

Preferably, at the position where the upper portion of the container cap engages with the plunger, a waterproof ring extends upwardly, said waterproof ring seals with the upper portion of the plunger when the nozzle head is locked Preferably, the nozzle head has a downward protruding inner pipe, which is inserted into the plunger to connected therewith.

Preferably, an inner hole of the inner pipe is a non-round hole.

Preferably, said plunger is divided into two parts.

The lotion pump of the present invention can be realized by a very simple structure, minimum parts and a very low manufacturing cost. While greatly increasing the productivity, it can obtain good sealing and leak-proof performance.

In the following, the description will be made in conjunction with the accompanying drawings so that the objects, features and advantages of present invention can be more clearly understood.

EMBODIMENTS

Figure 1:
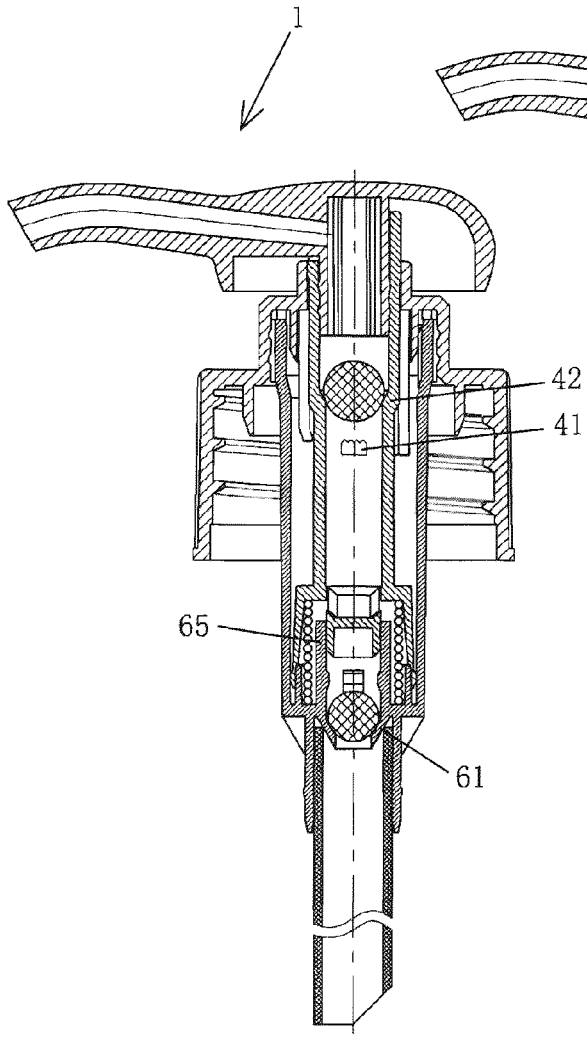
FIG. 1 is a sectional view of a lotion pump according to a preferred embodiment of the present invention, in which the nozzle head is pressed down and is in a locked state.
Figure 2:
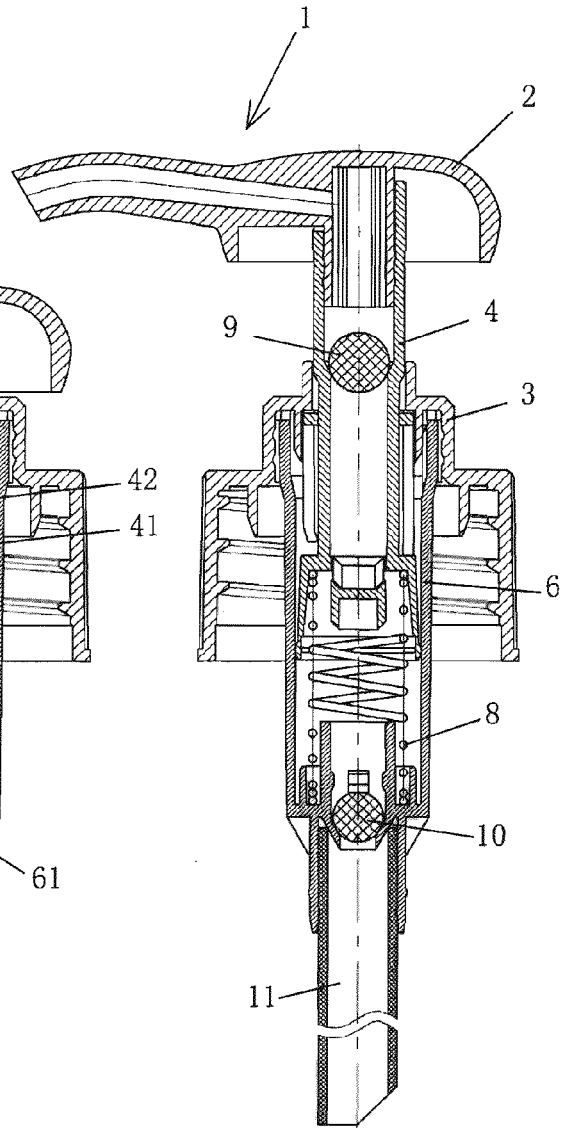
FIG. 2 is a sectional view of the lotion pump, in which the nozzle head is returned by a spring and is in non-locked state.
Figure 3:
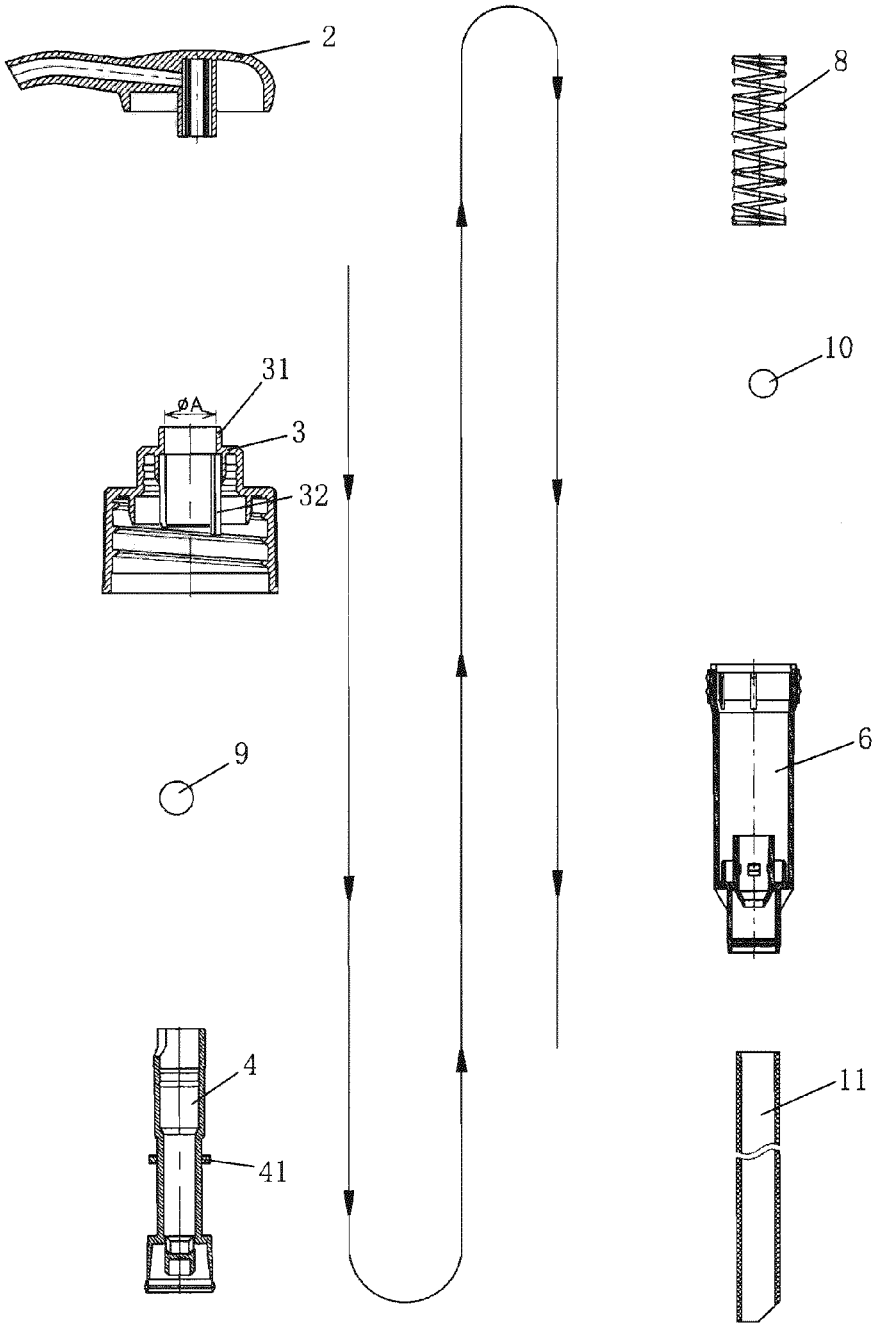
FIG. 3 is an exploded sectional view of the lotion pump.

Please refer to the accompanying drawings, in which the lotion pump is indicated by a numeral 1. As shown in FIG. 1-FIG. 3, the lotion pump 1 mainly includes a nozzle head 2, a container cap 3, a plunger 4, a housing 6, a return spring 8, an upper ball 9, a lower ball 10 and a sucking pipe 11.

The basic operation principle of the lotion pump is similar to the prior art. In particular, the upper ball 9 and the valve seat 42 on the plunger 4 constitute the upper one-way valve, the lower ball 10 and the valve seat 61 on the housing 6 constitute the lower one-way valve. When the nozzle head 2 is pressed downwardly, the upper one-way valve is opened, and the lower one-way valve is closed, the lotion in the pump chamber is pumped out. When the nozzle head 2 moves upwardly, the upper one-way valve is closed, and the lower one-way valve is opened, the lotion in the bottle is sucked into the pump cavity by the sucking pipe 11.

FIG. 1 shows that the nozzle head 2 is pressed down and is in a locked state or position. The "locked state or position" means that the nozzle head 2 is locked and is unable to pump lotion out. In this state, it is convenient for the transportation and storage. FIG. 2 shows that the nozzle head 2 is returned or restored by the spring 8 and is in a non-locked state, in this state, the lotion pump can be used to pump lotion out.

Figure 4A:
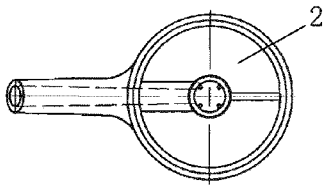
FIGS. 4*a*, 4*b*, 4*c* are respectively a bottom view, a sectional view and a front view of the nozzle head.
Figure 4B:
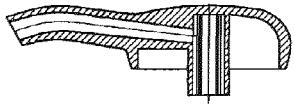
Figure 4C:
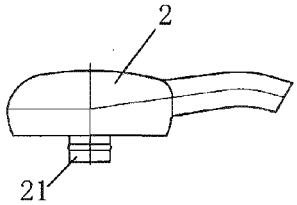
Figure 6:
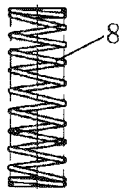
FIG. 6 is a front view of the return spring.

As shown in FIG. 1 and FIG. 2, the nozzle head 2 is connected to the plunger 4. As shown in FIG. 4*a*-4*c*, the nozzle head 2 has no complex screw thread structure, but it has a downward inner pipe 21, which is combined with the plunger 4 by being inserted into the plunger 4. Some ribs can be arranged on the inner pipe 21 or on the plunger 4 to enhance the combination therebetween. In addition, non-rounded design can be used for the inner hole of the inner pipe 21, therefore, when the upper ball 9 is pushed to an upper stop point by the lotion, the non-rounded design can not only prevent the upper ball 9 from overrun, but also allow the lotion to pass through, the liquid passageway will not be blocked.

As shown in FIG. 1 and FIG. 2, the container cap 3 is connected with the housing 6. In this embodiment, a rib-groove connection structure can be provided between the container cap 3 and the housing 6, the ribs can be provided on the housing 6 and the grooves can be provided on the container cap 3, and vice versa. If the rib-groove connection is used, the container cap 3 and the housing 6 can be connected easily by a snap connection. As compared with the connection by screw threads, which requires high precision, its manufacturing and mounting processes are simpler. In addition, after the outer side on the upper end of the housing 6 and the corresponding portion of the container cap are combined with each other, longitudinal air grooves are formed, after the inner side of the upper end of the housing 6 and the corresponding portion of the container cap are combined with each other, longitudinal air grooves are also formed. Furthermore, after the upper end surface of the housing is combined with the corresponding lower surface of the container cap, a gap or notch is formed. Since the air grooves on these three surfaces are communicated with each other, the function of preventing liquid from entering can be realized without a balancing air hole on the housing.

Figure 5A:
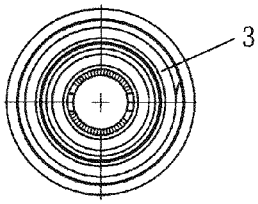
FIGS. 5*a*, 5*b* are respectively a bottom view and a sectional view of the container cap.
Figure 5B:
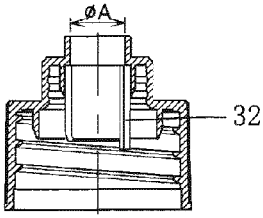
Figure 7A:
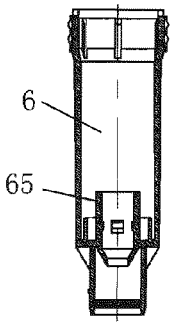
FIGS. 7*a*, 7*b*, 7*c* are respectively a sectional view, a top view, a bottom view and a front view of the housing.
Figure 7C:
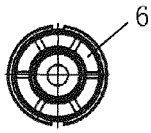

As shown in FIG. 1, FIG. 2 and FIG. 5*b*, there is a slightly upwardly extending waterproof ring 31 in the portion where the container cap 3 engages with the plunger 4, to prevent foreign matter, such as the shower water, from flowing into the pump and the bottle. When the nozzle head is locked, the waterproof ring 31 and the upper portion of plunger 4 constitute a seal. At the non-locked upper stop position of the nozzle head, the engagement between the inner surface of the waterproof ring 31 and the outer surface of plunger also constitutes a seal, so that it is not easy for the shower water to enter into the pump and the bottle.

As shown in FIGS. 1, 2 and 8*a*-8*c*, in this embodiment, the diameter of the upper portion of the plunger 4 is larger than that of its lower portion, thereby a step is formed at the position where the diameter is changed, and this step forms the valve seat 42 of the upper one-way valve. This valve seat 42 is different from the conventional "V" valve seat in prior art. The valve seat formed by the varying-diameter plunger is rather simple in mold design and manufacturing process, especially, because the core can be taken out from the upper end, it is convenient to arrange a sealing plug on the lower end of the plunger (which will be described in details in the following). The valve seat structure of this embodiment is an important feature of the present inventions. In addition, there is a notch 44 on the plunger 4, since its position corresponds to that of the nozzle of the nozzle head 2, it has the function of preventing relative rotation therebetween.

Figure 8A:
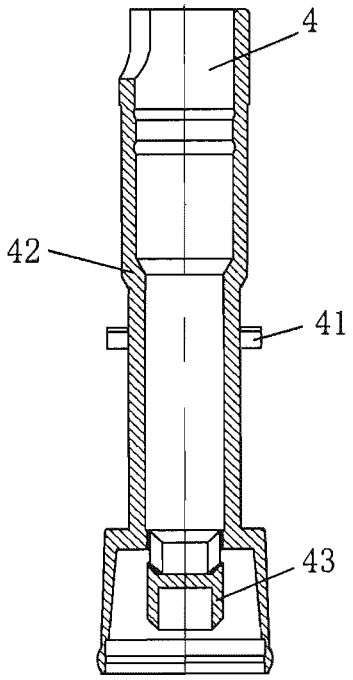
FIGS. 8*a*, 8*b*, 8*c* are respectively a sectional view, a front view and a top view of the plunger.
Figure 8B:
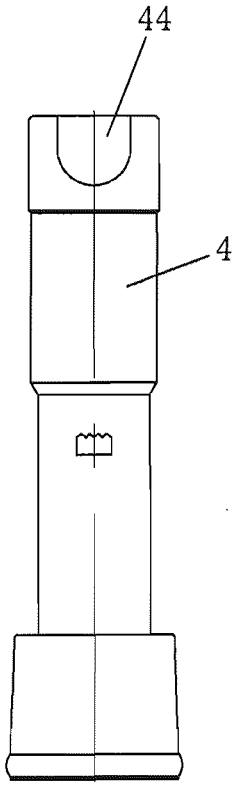
Figure 8C:
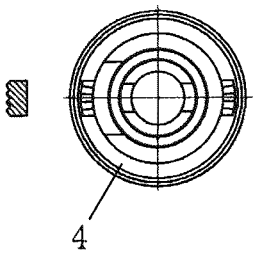

As shown in FIG. 1 FIG. 2 and FIG. 8*a*, in this embodiment, a sealing plug 43 extends downwardly from the lower portion of the plunger 4, and a sealing ring 65 extends upwardly from the lower portion of the housing 6. When the nozzle head is locked, the sealing plug 43 of the plunger 4 and the sealing ring 65 of the housing 6 engage with each other to realize the seal, which guarantees that the leakage from the nozzle will not occur. As least one through hole is formed between the plunger 4 and its sealing plug 43, thereby forming a lotion passageway. The positions of the sealing plug 43 of the plunger 4 and the sealing ring 65 of the housing 6 are interchangeable to realize the same object. In addition, some sealing ribs can be arranged on the outer surface of the sealing plug 43 to enhance the sealing effect.

As shown in FIG. 1, FIG. 2, FIG. 5*a*-FIG. 5*c*, FIG. 8*a*-FIG. 8*c*, at least one guiding block 41 is disposed on the outer side of the plunger 4, and the number of the guiding block may be one, two or even more, and it will be preferable that they are disposed concentrically with the same central angle. A guiding groove 321 on the inner ring 32 of the container cap 3 may engage with the guiding block 41 on the plunger 4. When the guiding block 41 moves up and down in the guiding groove 321, the lotion pump is in the state of operation (FIG. 2). After the nozzle head 2 is pressed to the lower stop position, it is rotated clockwise, the nozzle head is in the locked state (FIG. 1). In this embodiment, the guiding groove 321 is a recess, this "recess" means that it is formed by passing through the entire wall thickness. When the nozzle head is locked, the upper surface of the guiding block 41 will stop under the horizontal portion formed by the wall thickness. Using this "recess" structure, which passes through the entire wall thickness, the raw material can be saved, and since the contact area between the guiding block and the wall thickness is larger, the engagement strength can be increased.

Figure 5C:
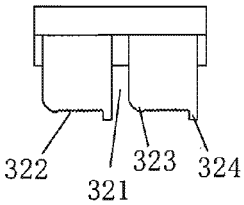
FIG. 5*c* is a developed view along the ϕ A in FIG. 5*b;*
Figure 7B:
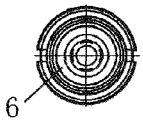
Figure 7D:
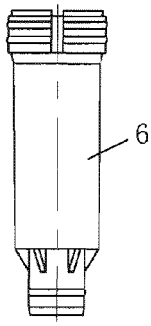

In addition, the guiding groove 321 may be in the form of notch, the "notch" means that it is unnecessary to pass through the whole wall thickness, it needs only to be recessed into a portion of the wall thickness. In this case, when the nozzle head is locked, the upper surface of the guiding block 41 will engage with a portion of the lower surface 322 of the inner ring 32 and hence stop, As shown in FIG. 5*c*, one side of the lower portion of the guiding groove 321 is in an arc shape so that the guiding block 41 can easily slide out of the notch. In addition, there is a small protrusion 323 on the arc portion to prevent the guiding block 41 from sliding back to the notch. On the other side of the lower portion of the guiding groove 321, there is another protrusion 324 to limit the rotation of the guiding block 41, thereby theoretically the locking angle of the nozzle head can reach 0°-180°. Preferably, there is an engagement means on the lower surface 322 of the inner ring 32 and on the upper surface of the guiding block 41 for making them engage with each other. The engagement means may be, for example, two sets of linear strips and it is preferable that they correspond to each other, and are radially and concentrically arranged with the same central angle. After the nozzle head 2 is adjusted to a desired direction, the engagement means (the two sets of strips) can keep the nozzle head in this direction so that make it not easy to move. The engagement means may be in other forms, for example, an engagement means (structure) in which a cutting edge type engagement structure can be disposed on the upper surface of the guiding block 41.

As shown in FIG. 1 and FIG. 2, the spring 8 may be a conventional spring with a non-varying diameter. Its lower end abuts against the bottom of the housing 6 and its upper end abuts against the head of the plunger 4. In addition, in the inner hole at the lower portion of the housing 6, there are a valve seat 61 and a lower ball 10, both of which constitute the lower one-way valve. The sucking pipe 11 is disposed on the lower end portion of the housing 6, and is communicated with the bottom of the bottle.

Although the present invention is described in details in conjunction with the preferred embodiment, it should be understood that the person skilled in the art can make various equivalent modifications and variants on the basis of the disclosed content. For example, the positions of the locking structure of the nozzle head are interchangeable, i.e., the guiding block may be disposed on the connection guide pipe and the guiding groove may be disposed on the container cap, or the guiding block may be disposed on the container cap and the guiding groove may be disposed on the plunger; the plunger and the piston can be divided into two separate parts (at this time, the plunger is called the connecting/guiding pipe), this will bring convenience in manufacturing process; the rib-groove connection structure may be replaced by screw threads connection. Therefore, the protection scope of the present invention should be defined by the appended claims.

The invention claimed is:

1. A lotion pump, comprising:

a nozzle head only including an integrally formed nozzle head body, the nozzle head body having an outlet and an inlet;

a plunger connected with the inlet of the nozzle head, in which an upper one-way valve is disposed, the plunger only including an integrally formed plunger body, the plunger body having an upper portion that has a larger inner diameter and a lower portion that has a smaller inner diameter, an outer diameter of the upper portion of the plunger being larger than an outer diameter of the lower portion of the plunger, the upper and lower portions of the plunger body being connected at a stepped portion of the plunger, a valve seat being formed between the upper and lower portions, the plunger body further having an integrally formed sealing plug extending downwardly therefrom;

a housing, in which a lower one-way valve is disposed, the housing only including an integrally formed housing body, the housing body having an integrally formed sealing ring engageable with the sealing plug to prevent lotion from leakage;

a container cap only including a cap body secured to the housing body; and a return spring disposed in the housing for restoring a position of the nozzle head, an upper end of the return spring being positioned to abut a head of the plunger, a lower end of the return spring positioned to abut the housing, wherein the nozzle head is operable between a locked position where axial movement of the nozzle head relative to the housing is prevented and an unlocked position where the nozzle head is axially movable relative to the housing, wherein a first air groove is formed between an outer side of an upper end of the housing and a corresponding portion of the container cap, a second air groove is formed between an inner side of the upper end of the housing and a corresponding portion of the container cap, and a gap is formed between an upper end surface of the housing and a corresponding portion of the container cap, the first air groove, the second air groove and the gap communicate with each other to allow air outside of the housing to communicate with air inside the housing.

2. The lotion pump according to claim 1, wherein an inner ring is disposed in the container cap, any one of at least one guiding groove and at least one guiding block is disposed on the inner ring, and the other one of the at least one guiding groove or the at least one guiding block is disposed on the lower portion of the plunger.

3. The lotion pump according to claim 2, wherein on the lower surface of the inner ring and on the upper surface of the guiding block, there is an engagement means for making them engage with each other.

4. The lotion pump according to claim 2, wherein one side of a lower portion of the guiding groove is in an arc shape, and on the other side there is a protrusion to limit the rotation range of the guiding block.

5. The lotion pump according to claim 1, wherein said container cap and said housing are connected by means of ribs and grooves.

6. The lotion pump according to claim 2, wherein at the position where the upper portion of the container cap engages with the plunger, a waterproof ring extends upwardly, said waterproof ring seals with the upper portion of the plunger when the nozzle head is locked by engagement between the guiding groove and the guiding block.

7. The lotion pump according to claim 1, wherein the nozzle head has a downward protruding inner pipe, which is inserted into the plunger to connect therewith.

8. The lotion pump according to claim 7, wherein an inner hole of the inner pipe is a non-round hole.

9. The lotion pump according to claim 1, further comprising an inner ring disposed in the container cap, the inner ring being surrounded by an inner side of the container cap, the upper end of the housing being disposed between the inner ring and the inner side of the container cap and forming a longitudinal passageway, the longitudinal passageway including the first and second air grooves and the gap.

* * * * *